US005931985A

United States Patent [19]

Schoeler et al.

[11] Patent Number: 5,931,985

[45] Date of Patent: Aug. 3, 1999

[54] PROCESS AND DEVICE FOR BLOWING OXYGEN-CONTAINING GAS WITH AND WITHOUT SOLID MATERIAL ON A METAL MELT IN A METALLURGICAL VESSEL

[75] Inventors: Horst-Dieter Schoeler; Ulrich Meyer, both of Duisburg, Germany; Anatoly Sizov, St. Petersburg, Russian Federation

[73] Assignee: Mannesmann Aktiengesellschaft, Düsseldorf, Germany

[21] Appl. No.: 08/836,688

[22] PCT Filed: Oct. 27, 1995

[86] PCT No.: PCT/DE95/01521

§ 371 Date: May 19, 1997

§ 102(e) Date: May 19, 1997

[87] PCT Pub. No.: WO96/16190

PCT Pub. Date: May 30, 1996

[30] Foreign Application Priority Data

Nov. 18, 1994 [DE] Germany ..... 44 42 362

[51] Int. Cl.[6] ..... C21C 5/32; C21C 7/10

[52] U.S. Cl. ..... 75/414; 75/512; 75/529; 75/531; 75/532; 75/533; 75/537; 75/538; 75/540; 75/543; 75/544

[58] Field of Search ..... 266/208, 225; 75/414, 512, 529, 533, 532, 537, 538, 543, 544, 531, 540

[56] References Cited

U.S. PATENT DOCUMENTS

| | | | |
|---|---|---|---|
| 5,060,867 | 10/1991 | Luxton et al. | 431/9 |
| 5,571,307 | 11/1996 | Sizov et al. | 266/225 |
| 5,714,113 | 2/1998 | Gitman et al. | 266/225 |

*Primary Examiner*—Melvyn Andrews

*Attorney, Agent, or Firm*—Cohen, Pontani, Lieberman & Pavane

[57] ABSTRACT

A process for blowing oxygen-containing gas, with and without solid material, on a metal melt in a metallurgical vessel, a process for generating a burner flame and corresponding devices. The inventive process and lance suitable for such process provides, without structural conversion and by a simple design, various different process steps in the treatment of metal melts in a metallurgical vessel while increasing the insertion rates of the individual media. This is accomplished using a multifunctional lance in which the process of blowing oxygen with and without solids, and the generation of a burner flame may be performed independently from one another. The individual supply lines are connected in a corresponding manner depending on the respective process step. In the process for blowing oxygen-containing gas, vibrations are excited in the gas flow in a relatively simple manner.

24 Claims, 3 Drawing Sheets

PROCESS AND DEVICE FOR BLOWING OXYGEN-CONTAINING GAS WITH AND WITHOUT SOLID MATERIAL ON A METAL MELT IN A METALLURGICAL VESSEL

BACKGROUND OF THE INVENTION

1. Field of the Invention

The present invention is directed to a process for blowing oxygen-containing gas, with and without solid material, on a metal melt in a metallurgical vessel, a process for generating a burner flame and corresponding devices.

2. Description of Related Art

Processes and devices by which oxygen is blown on a metal melt and by which the melt can be heated by admixing fuel are known. For example, European Patent publication 0 584 814 A2 discloses a top-blow lance with a Laval-type mouth construction and bore holes though which a combustible medium is injected into the main flow of the lance. The main flow, comprising oxygen or oxygen-containing gas, exits the lance nozzle at supersonic velocity, but under conventional flow conditions. The lance disclosed in this reference has a water-cooled jacket but does not provide a device for injecting solids.

Installations in which solids may be added ordinarily have addition devices. For example, German Patent publication 20 26 780 C2 discloses an addition hopper which is inserted in the cover of the vessel and through which solid material—in this case, scale as oxidizing agent—may be added to the melt.

German Patent publication 29 18 213 C2 discloses a process and a device for metallurgical treatment of metal melts in which a multiple-phase treatment is made possible in a single device in which, while retaining the closing hood, at least a first device—an electrode, in the present case—which is guided through the cover is replaced by a second device, in this case a fresh lance.

It is the object of the present invention therefore to provide a process and a lance suitable for such process as a unitary structural component part in which, in a simple design and without structural conversion, various different process steps in the treatment of metal melts in a metallurgical vessel may be performed while increasing the insertion rates of the individual media.

SUMMARY OF THE INVENTION

The present invention is directed to a lance for treating liquid metal melts in metallurgical vessels, especially steel under vacuum in RH vessels, the lance having at its top at the inner feed pipe of the lance a Laval-type opening for guiding oxygen and a cooling jacket along its entire length. The lance is connected at the bottom end to an oxygen and coolant supply station. A deflector ring is fastened in the oxygen feed pipe at a distance $I_B$ in the direction of the flow of gas in front of the narrowing critical diameter of between 0.7 and 0.9 $D_S$, where $D_S$ is the clearance width of the oxygen feed pipe. A solids feed pipe is provided in the oxygen feed pipe so as to be held at the bottom end and guided coaxially thereto, this solids feed pipe ends at the top in front of the deflector ring in the direction of the flow of gas at a distance $I_P$ of between 0.1 to 0.3 $D_S$. The deflector ring preferably has a construction downstream which is comparable with a Laval-type lance mouth. In addition, the narrowing may include adjusting elements by which the critical diameter $D_K$ may be adjusted such as tilting levers which are supported at one end.

The lance may be constructed to include nozzles arranged in the Laval-type lance mouth, which are connected to supply lines. The lance having a cooling jacket along its entire length and communicating at the bottom end with a supply station supplying oxygen, coolant and fuel gas. A deflector ring is fastened in the oxygen feed pipe at a distance $I_B$ of between 0.7 to 0.9 $D_S$, where $D_S$ is the clearance width of the oxygen feed pipe. Provided in the oxygen feed pipe is a pipe which is held at the bottom end, guided coaxially thereto and ending at the top in front of the deflector ring in the direction of the flow of gas at a distance $I_P$ of between 0.1 to 0.3 $D_S$. At least six nozzles are arranged as groups of at least three, each in a horizontal plane. The first nozzle is at a distance $I_D$ from the narrowing which is greater than 1.4 $D_K$, where $D_K$ is the critical diameter. The nozzles are constructed as vibration generators of which between 9 and 60 nozzles are provided. An expansion stage with a length $L_G$ and a diameter $D_G$ is provided at the mouth end which serves as the vibration generator. Each nozzle has a length $L_d$ of between 10 mm and 50 mm and a diameter $D_D$ of between 3 mm and 15 mm, wherein $D_G/D_D$ is between 1.1 and 2.2 and $L_G/D_D$ is between 0.3 and 1.8.

The present inventive lance is also constructed so as to transport solid materials. In order to transport solid materials the lance is, accordingly, connected to a supply station for supplying transporting gas and solids. A deflector ring is fastened in the oxygen feed pipe at a distance $I_B$ in the direction of gas flow in front of the narrowing critical diameter of between 0.7 and 0.9 $D_S$, where $D_S$ is the clearance width of the oxygen feed pipe. A solids feed pipe is disposed at the bottom end in the oxygen feed pipe and guided coaxially thereto so as to be displaceable such that its penetration depth into the oxygen feed pipe is adjustable. The solids feed pipe penetrates at the top into the oxygen feed pipe to a depth such that it opens out downstream via the deflector ring and the narrowing critical diameter $D_K$ at a distance $I_K$ greater than 0.1 $D_S$, where $D_S$ is the clearance width of the oxygen feed pipe.

The invention is a multifunctional lance in which the processes of blowing oxygen, with and without solids, and generating a burner flame are possible independently of one another. The respective process step requires only that the individual supply lines be suitably connected; the blowing of oxygen with solids requires only that the solids feed pipe be moved deeper into the lance. In each process step, maximum insertion rates are made possible particularly by exerting influence on the media flow behavior. Thus, in the process for blowing oxygen-containing gas, the gas flow is caused to vibrate in a particularly simple manner, namely, in that the volume of gas impinges on the surface of the liquid melt in a particularly gentle manner, in spite of the high quantities, in the form of longitudinal waves.

In particular, the present inventive process for blowing oxygen-containing gas on a metal melt in a metallurgical vessel, especially a steel melt under vacuum in an RH vessel, begins by guiding oxygen or oxygen-enriched gas annularly through a lance directed to the melt. After a predetermined distance, the annular gas flow is expanded to a full flow with a circular cross section. While continuing to move forward, the gas flow is deflected in its outside area on an obstacle constructed as an annular diaphragm. The gas flow deflected on the obstacle flows back and, in so doing, impacts with the gas flow flowing in the direction of the melt and excites vibrations in this gas flow. Then the gas flow in which vibrations have been excited and which flows through the opening of the annular obstacle subsequently flows through the critical cross section of a Laval-type lance mouth and exits the lance mouth at supersonic velocity.

The process and device in accordance with the invention are suitable for the treatment of metal melts under atmospheric pressure or under a vacuum.

When the lance is used to generate a burner flame, not only is the main oxygen flow caused to pulsate, but vibrations are also excited in the fuel gas and, in so doing, its frequency is adapted such that an appreciable increase and a more intensive mixing of the individual media is effected in comparison to conventionally flowing media. The pulse frequency of the oxygen is between 60 Hertz and 90 Hertz with a pressure of 3 bar to 11 bar at a quantity of between 200 $Nm^3/h$ and 3000 $Nm^3/h$. The pulse frequency of the fuel gas has a comparable magnitude, for example, a pulse frequency between 60 Hz and 900 Hz at a pressure between 4 bar and 20 bar, wherein the pressure is easily greater than that of the main gas. Natural gas, coke gas and comparable gases may be used as fuel gas. The fuel gas is injected into the oxygen flow in small doses via a plurality of nozzles. The individual nozzles have a predetermined angle depending on the distance between the critical diameter and Laval-type lance mouth, which angle takes into account the instantaneous gas velocity and the actual vibration mode. The individual nozzles themselves are constructed as generators so that vibrations are excited in the fuel gas in a simple manner directly before being mixed into the main flow. The fuel gas may be fed via an annular gap defined by the fuel gas feed pipe and the oxygen feed pipe or via an individual fuel feed line.

In order to generate a burner flame in the free space of the metallurgical vessel in accordance with the invention fuel gas is guided to the Laval-type lance mouth simultaneously with the transporting of the oxygen or oxygen-containing main flow. The fuel gas is then distributed to a plurality of nozzles in the region of the lance mouth and vibrations are excited in the fuel gas in the nozzles. The fuel gas is fed through the nozzles in the interior wall of the Laval-type lance mouth in moving individual flows so as to be inclined at an angle to the center axis of the lance. In the interior of the Laval-type lance mouth the vibrating individual flows of fuel gas are mixed with the vibrating oxygen or oxygen-containing main flow and the fuel gas-oxygen mixture exits the Laval-type lance mouth at supersonic velocity.

When blowing oxygen and solid matter simultaneously, the solids feed lance is positioned with its mouth behind the critical diameter in the direction of flow. The granular, or even dustlike, solid materials are transported by a transporting gas. This gas-solids mixture is entrained at the mouth of the solids transporting lance by oxygen flowing past the mouth. To further increase this effect it is suggested to design the mouth in such a way that the circumference of the mouth region is greater than the circumference of the tubular solids pipe. This is effected most simply by providing a star-shaped bead or flange at the mouth region. Given the same cross-sectional surface, the oxygen jet flowing past at high speed has a larger circumference at its disposal for carrying away transporting gas charged with solid matter.

The inventive process for blowing oxygen-containing gas enriched with solids on a metal melt in a metallurgical vessel begins by guiding oxygen or oxygen-enriched gas annularly through a lance directed to the melt. Before reaching the critical diameter of a Laval-type lance mouth, the annular gas flow is deflected in its outside area on an obstacle formed as an annular diaphragm. The gas flow deflected on the annular obstacle flows back and, in turn, impacts, with the residual annular flow flowing in the direction of the melt and excites vibrations in the latter. While retaining its annular shaped, the vibrating residual annular flow flows past the obstacle through the critical cross section of the lance mouth. A fine-grained solid material is transported by a transporting gas up to the lance mouth coaxially to the oxygen or oxygen-containing gas and simultaneously with the transporting thereof. The annular main flow of oxygen or oxygen-containing gas moving at supersonic velocity entrains the more slowly moving solids-gas mixture and mixes with it. This mixture of oxygen, transporting gas and solid matter then exits the lance mouth at supersonic velocity while vibrating. The solid material is a metallic or graphite-containing solid material, for example, $Fe_2O_3$, Al or C, with a grain size between 0.1 mm and 0.3 mm and is preferably fed at a rate of between 60 kg/min and 250 kg/min.

In another embodiment a deflector ring, which excites vibrations in the main flow, may be provided downstream in the form of a Laval-type lance mouth so as to prevent unwanted obstructions following the orifice or diaphragm.

In order to excite optimum vibrations in the main gas flow at any conceivable gas quantity without exchanging the lance, the narrowing in the critical diameter of the Laval nozzle is preferably constructed so as to be adjustable, as for example a tilting lever supported at one end and tilted in an adjustable manner.

DETAILED DESCRIPTION OF THE PRESENTLY PREFERRED EMBODIMENTS

Figure 1:
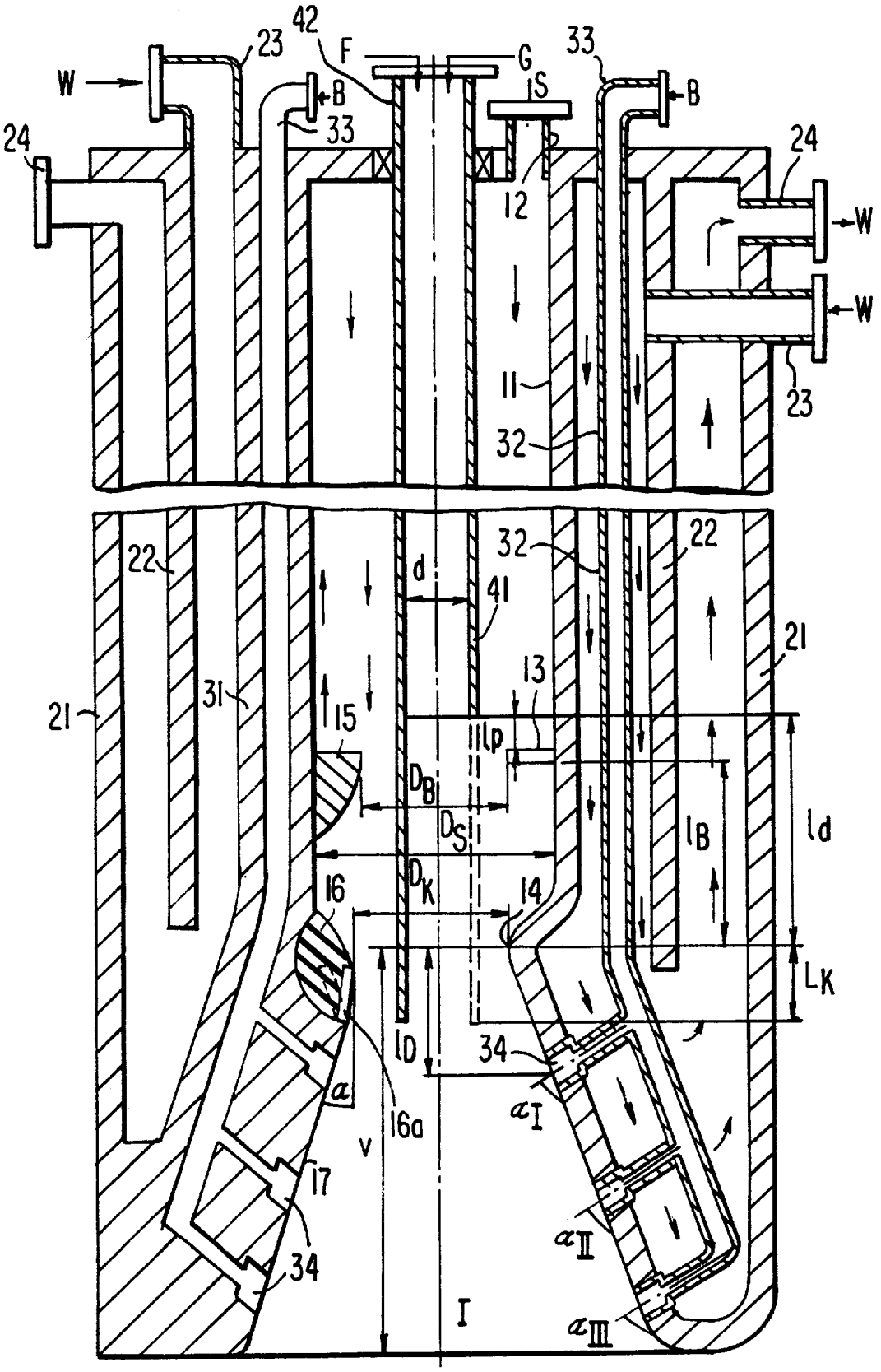
FIG. 1 is a schematic view of a lance with all of the constructional elements for carrying out the different processes in accordance with the present invention.

FIG. 1 shows a lance comprising a water feed pipe 21 and an oxygen feed pipe 11 which is connected to the latter at the bottom end and is enclosed by a water separator shield 22 which is likewise connected at the bottom end to the water feed pipe 21. The left-hand side of FIG. 1 shows a fuel gas feed pipe 31 which encloses the oxygen feed pipe 11 and opens a gap-like free space for the supply of fuel gas. The right-hand side of FIG. 1 shows a fuel gas feed line 32 which leads directly from the bottom to the top of the lance. The individual media—water W, fuel gas B, solid matter F, transporting gas G, and oxygen S—are conveyed to and from the lance by individual connections, namely, the oxygen feed 12, water feed 23, water discharge 24, fuel gas feed 33 and solids feed 42.

Arranged in the center of the oxygen feed pipe 11 having a diameter $D_S$ is a solids feed pipe 41 with a diameter d which may be inserted to a predetermined penetration depth into the oxygen feed pipe 11 as a solids feed pipe. A deflector ring 13 is fastened in the oxygen feed pipe 11 at a distance $_B$ upstream from the critical diameter $D_K$ 14 of the Laval-type lance opening in the direction of flow. The deflector ring 13 has a free passage $D_B$. The deflector ring 13 may have a Laval-type construction 15 on its downstream side. This critical diameter 14 may be varied using adjusting elements 16. The adjustable elements 16 may include a tilting lever 16*a* pivotally mounted at one end so that the other end of the tilting lever 16*a* determines the length of the critical diameter 14.

When the lance is used as a simple blowing lance without solids, the pipe 41 opens out at a distance Ip upstream from the deflector ring 13 in the direction of flow and a distance $I_d$ upstream from the critical diameter 14.

When the pipe 41 is used as a solids feed pipe, this pipe is displaced in such a way that it projects through the free space of the deflector ring 13 and the narrowing of the critical diameter 14 to a position where the mouth of the pipe 41 is at a distance $I_K$ downstream of the narrowing 14.

Nozzles 34 having an expansion stage 35 are provided in the Laval nozzle region 17 of the oxygen feed pipe 11. The nozzles 34 have an angle $\alpha$ relative to a respective plane vertical to the center axis of the lance I, which angle $\alpha$ becomes flatter (smaller) the greater the distance between the individual nozzle 34 and the critical diameter 14. The first nozzle 34 is between 10° and 30° at a distance of at least $I_D$ from the critical diameter 14. The individual arrows show the flow direction of the medium.

Figure 2C:
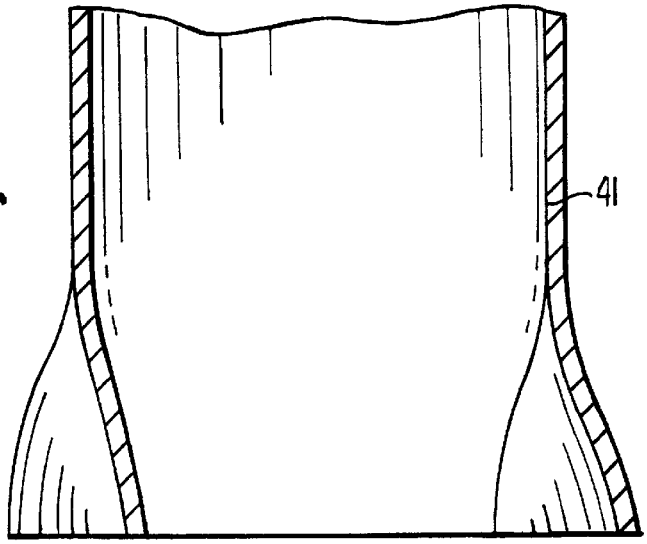
FIG. 2*c* shows a cross-sectional view of the mouth region of the solids transporting lance of FIGS. 2*a* and 2*b* along line B—B.
Figure 2B:
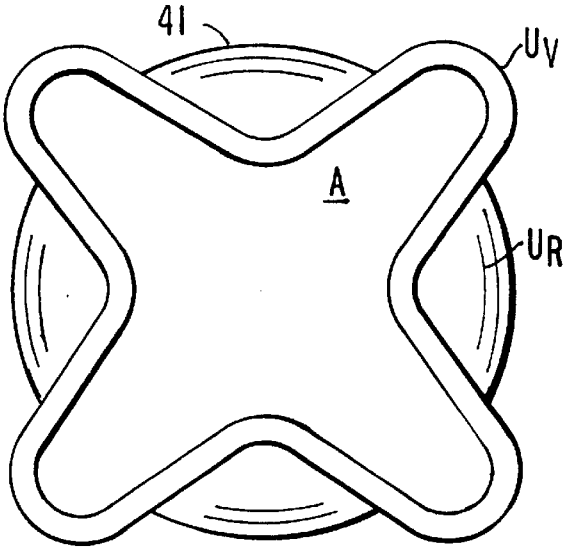
FIGS. 2*a* and 2*b* show different star-shaped configurations of the mouth region of the solids transporting lance.
Figure 2A:
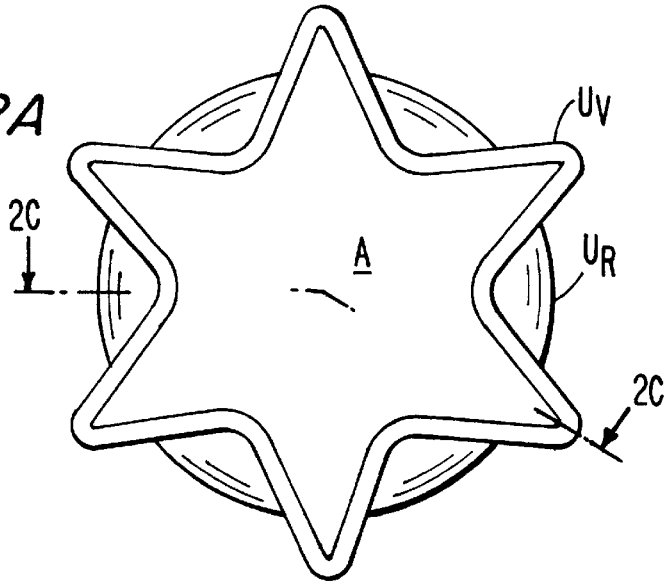

FIGS. 2*a*–2*c* show the mouth region of the solids feed pipe 41 with a star-shaped flange. Due to the special shape, the solids feed pipe 41 has a constant cross section A, wherein the circumference of the deformed part $U_V$ is greater than the circumference of an undeformed tubular pipe $U_R$, preferably $U_V/U_R$ is between 1.1 and 1.3.

Figure 3:
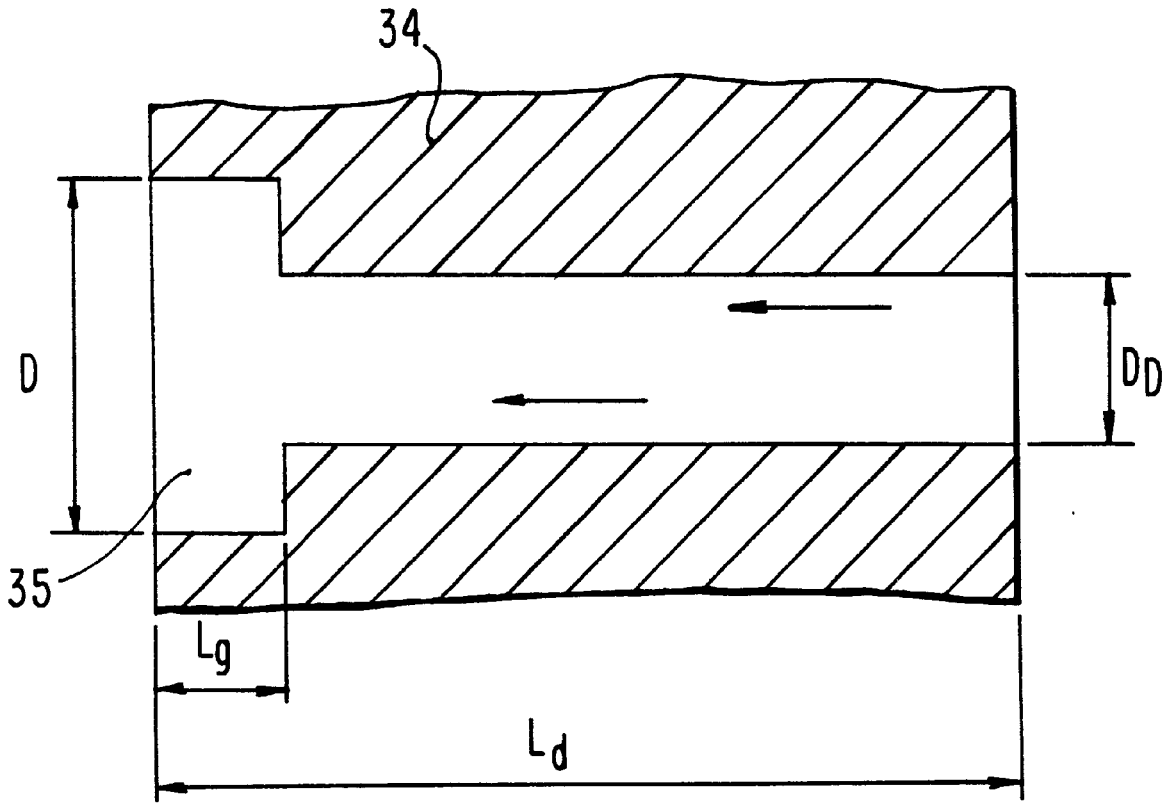
FIG. 3 is a schematic view of the fuel nozzle.

FIG. 3 shows a nozzle 34 with an expansion stage 35 on the output side. Also shown are the length of the nozzle $L_d$, the length of the generator $L_g$, the diameter of the nozzle $D_D$ and the diameter of the generator $D_G$.

What is claimed is:

1. A process for blowing oxygen-containing gas on a metal melt in a metallurgical vessel having a free space and generating a burner flame in the free space of the metallurgical vessel, said process comprising the steps of:

(a) guiding one of an oxygen and an oxygen-containing gas into a bottom end of an annular flow chamber in a lance having a Laval mouth at a top end of the annular flow chamber directed towards the melt;

(b) after a first distance from the bottom end, expanding the gas such that an annular gas flow having a circular cross section progresses through the annular flow chamber from the first distance toward the top end;

(c) deflecting a outer circumferential portion the annular gas flow using an annular obstacle positioned at an outer wall in the annular flow chamber between the first distance and the top end thereby generating a deflected gas flow;

(d) exciting vibrations in the annular gas flow through impact of the deflected gas flow with the portion of the annular gas flow which continues flowing towards the melt; and (e) discharging from the Laval mouth at supersonic velocity, the annular gas flow downstream beyond the annular obstacle and a critical cross-section of the Laval mouth after said step of exciting vibrations, the critical cross-section being a narrowmost cross-section of the Laval mouth.

2. The process in accordance with claim 1, further comprising the steps of (f) guiding a fuel gas to the Laval mouth simultaneously with the annular gas flow;

(g) distributing the fuel gas to a plurality of nozzles disposed in an interior wall in a region of the Laval mouth;

(h) exciting vibrations in the fuel gas distributed to each of the plural nozzles;

(i) feeding the fuel gas through each of the plural nozzles so that a flow of the fuel gas through each of the plural nozzles is inclined at an angle relative to a center axis of the lance;

(j) mixing in the interior wall of the Laval mouth the flow of the fuel gas through each of the nozzles with the annular gas flow to produce a fuel gas-oxygen mixture; and (k) discharging the fuel gas-oxygen mixture from the Laval mouth at supersonic velocity.

3. The process in accordance with claim 2, wherein said step of exciting vibrations in the annular gas flow further comprises the step of setting a pulse frequency of the vibrations of the one of the oxygen and oxygen-containing gas between about 60 Hz and 900 Hz at a pressure of between about 3 bar and 11 bar at the critical cross-section at between about 200 $Nm^3/h$ to 3000 $Nm^3/h$.

4. The process in accordance with claim 2, wherein said step of exciting vibrations in the fuel gas further comprises the step of setting a pulse frequency of the vibrations of the fuel gas between about 60 Hz and 900 Hz at a pressure of between about 4 bar and 20 bar.

5. The process in accordance with claim 2, wherein said step of guiding fuel gas comprises guiding a natural gas.

6. The process in accordance with claim 1, wherein said process comprises blowing oxygen containing gas on a steel melt in an RH vessel under vacuum.

7. A process for blowing oxygen-containing gas enriched with solids on a metal melt in a metallurgical vessel, comprising the steps of:

(a) guiding an annular gas flow comprising one of an oxygen and an oxygen-containing gas annularly through a lance directed towards the melt;

(b) before reaching a critical diameter of a Laval mouth of the lance, deflecting a deflected portion of the annular gas flow using an annular obstacle positioned in the lance, the critical diameter being the narrowest diameter of the Laval mouth;

(c) exciting vibrations in the annular gas flow by impacting the deflected portion of the annular gas flow with another portion of the annular gas flow which continues flowing towards the melt such that the annular gas flow flows past the annular obstacle and through the critical diameter of the lance mouth while retaining its annular shape;

(d) transporting a solids-gas mixture comprising a fine-grained solid material using a transporting gas up to the Laval mouth coaxially and simultaneously with the one of the oxygen and oxygen-containing gas;

(e) mixing the annular gas flow of the one of oxygen and oxygen-containing gas with the solids-gas mixture to produce a mixture of the oxygen, transporting gas and solid material; and (f) discharging the mixture from the Laval mouth at supersonic velocity, wherein the mixture contains the vibrations excited in the annular gas flow.

8. The process in accordance with claim 7, wherein said step (d) further comprisestransmporting a fine-grained solid material having a grain size of between about 0.1 and 0.3 mm at a rate of between about 60 kg/min and 250 kg/min.

9. The process in accordance with claim 7, wherein said step (d) further comprises transporting a fine-grained solid material comprising one of metal and graphite.

10. The process in accordance with claim 9, wherein said step (d) further comprises transporting a fine-grained solid material comprising one of $Fe_2O_3$, Al and C.

11. A lance for treating liquid metal melts in metallurgical vessels, said lance having a top end and a bottom end for connection to an oxygen/coolant supply station and a cooling jacket along its entire length, said lance further comprising:

an oxygen feed pipe having a constant width and having a Laval mouth proximate said top end, said Laval mouth having a width which tapers toward a narrowmost portion having a critical diameter, said critical diameter being a narrowest diameter of said Laval mouth;

a deflector ring mounted in said oxygen feed pipe at a distance upstream from the narrowmost portion within the range including about 0.7 $W_c$ to 0.9 $W_c$, wherein $W_c$ is said constant width of said oxygen feed pipe; and a solids feed pipe having a top end and a bottom end, said solids feed pipe being disposed in said oxygen feed pipe while being held at said bottom end and coaxially displaceable therein so that the top end of said solids feed pipe is upstream of said deflector ring in a direction of gas flow at a distance of between about 0.1 $W_c$ to 0.3 $W_c$, wherein solids are not introduced into the gas flow.

12. The lance in accordance with claim 11, wherein said deflector ring comprises a downstream construction which corresponds to said Laval mouth.

13. The lance in accordance with claim 11, further comprising an adjusting element operatively movably disposed at said narrowmost portion of said Laval mouth for varying the critical diameter.

14. The lance in accordance with claim 13, wherein the adjusting element comprises a tilting lever pivotally supported at one end in said Laval mouth.

15. The lance in accordance with claim 11, wherein the metal melt is a steel melt and the metallurgical vessel is an RH vessel under vacuum.

16. A lance for treating liquid metal melts in metallurgical vessels, the lance having a top and a bottom for connection to an oxygen, coolant and fuel gas supply station and including a cooling jacket along its entire length, said lance comprising:

an oxygen feed pipe having a longitudinal axis, a constant width, and a Laval mouth proximate said top end, said Laval mouth having a width which tapers toward a narrowmost portion having a critical diameter, said critical diameter being a narrowest diameter of said Laval mouth;

an annular deflector ring mounted in said oxygen feed pipe at a distance upstream from the narrowmost portion within the range including about 0.7 $W_c$ to 0.9 $W_c$, wherein $W_c$ is said constant width of said oxygen feed pipe;

a solids feed pipe having a top end and a bottom end, said solids feed pipe being disposed in said oxygen feed pipe while being held at said bottom end and coaxially displaceable therein so that the top end of said solids feed pipe is upstream of said deflector ring in a direction of gas flow at a distance within the range including about 0.1 $W_c$ to 0.3 $W_c$ when solids are not introduced into the gas flow; and a plurality of nozzles defining vibration generators and connectable to the supply station by supply lines for receiving the fuel gas, said plural nozzles being arranged in the Laval mouth into groups of at least three nozzles, each said group lying in a horizontal plane perpendicular to said longitudinal axis, and a first nozzle of each said group being disposed downstream from the narrowmost portion at a distance greater than about 1.4 $D_c$, wherein $D_c$ is said critical diameter.

17. The lance in accordance with claim 16, wherein the number of nozzles is within a range including 9 to 60.

18. The lance in accordance with claim 16, wherein each of the plural nozzles has a length within the range including about 10 mm to 50 mm and a diameter within the range including about 3 mm to 15 mm and wherein each said plural nozzles comprises an expanded diameter portion defining a vibration generator disposed at an end of said each said plural nozzles opening into the Laval mouth and having a length and diameter, wherein a ratio of the diameter of said vibration generator to the diameter of said each said plural nozzles is between about 1.1 and 2.0 and a ratio of length of said vibration generator to the diameter of said each plural nozzles is between about 0.3 and 1.8.

19. The lance in accordance with claim 18, wherein a closest one of said plural nozzles to said narrowmost portion comprises a center axis having a bore hole angle within the range of about 10° to 30° between said center axis and a plane perpendicular to said longitudinal axis of said lance and each said plural nozzles thereafter having a smaller positive bore hole angle.

20. The lance in accordance with claim 16, further comprising a fuel gas feed pipe disposed around said oxygen feed pipe and separated therefrom by a distance to thereby define an annular gap through which fuel gas is fed to the nozzles.

21. The lance in accordance with claim 20, wherein the nozzles are connected in fluid communication to the supply station by the fuel gas feed pipe.

22. A lance for treating liquid metal melts in metallurgical vessels, the lance having a top and a bottom for connection to an oxygen/coolant supply station and including a cooling jacket along its entire length, said lance comprising:

an oxygen feed pipe having a longitudinal axis and a constant width; a Laval mouth proximate said top end on said oxygen feed pipe and having a width which tapers toward a narrowmost portion having a critical diameter, said critical diameter being a narrowest diameter of said Laval mouth;

an annular deflector ring mounted in said oxygen feed pipe at a distance upstream from narrowmost portion within the range including about 0.7 $W_c$ to 0. 9 $W_c$, wherein $W_c$ is said constant width of said oxygen feed pipe; and a solids feed pipe having a top end and a bottom end, said solids feed pipe being disposed in said oxygen feed pipe while being held at said bottom end and coaxially displaceable therein so that the top end of said solids feed pipe is displaced so that it opens out downstream of said deflector ring and narrowmost portion of said Laval mouth in a direction of flow of gas at a distance greater than about 0.1 $W_c$ when solids are to be added to the gas flow.

23. The lance in accordance with claim 22, wherein said solids feed pipe has a mouth and is tubular in shape with a tubular circumference except for a region of the mouth which is deformed with a deformed circumference, the tubular and deformed circumferences having a constant surface area and a ratio of the deformed circumference to the tubular circumference being between about 1.1 and 1.3.

24. The lance in accordance with claim 23, wherein the region of the mouth of said solids feed pipe has a star-shaped cross section.

* * * * *